US005753335A

United States Patent [19]

Harper

[11] Patent Number: 5,753,335

[45] Date of Patent: May 19, 1998

[54] SEMI-OPEN, MULTICOLOR PROCESS PRINTED DOILIES

[75] Inventor: Howard E. Harper, Redding, Conn.

[73] Assignee: Mafcote Industries, Inc., Norwalk, Conn.

[21] Appl. No.: 695,162

[22] Filed: Aug. 7, 1996

[51] Int. Cl.[6] ..... A47G 11/00

[52] U.S. Cl. ..... 428/66.5; 428/66.6; 428/131

[58] Field of Search ..... 428/7, 66.5, 66.6, 428/131

[56] References Cited

U.S. PATENT DOCUMENTS

| | | | |
|---|---|---|---|
| 690,951 | 1/1902 | Hess | 428/66.5 |
| 2,829,459 | 4/1958 | Halpern | 428/66.5 |
| 3,074,609 | 1/1963 | Altshuler et al. | 428/66.5 X |

OTHER PUBLICATIONS

Royal Lace Division of Mafcote Industries, Inc., "Christmas Doilies and Placemats," RL95–4.

*Primary Examiner*—Henry F. Epstein

*Attorney, Agent, or Firm*—Ware, Fressola, Van der Sluys & Adolphson LLP

[57] ABSTRACT

A doily includes a substrate with multicolor artwork coating substantially covering the top surface. The artwork coating is applied by four color, or more, process printing. A peripheral margin defines patterned cutouts which diminish the substrate and artwork coating, thereby relatively emphasizing the artwork coating in a substantially imperforate central area. The substrate is foil/paper lamination or paper, including precoated paper. The doilies are made by printing rolls of substrate sheet material, layering sheet from plural rolls, and cutting and embossing plural doilies in aligned stacks.

16 Claims, 2 Drawing Sheets

SEMI-OPEN, MULTICOLOR PROCESS PRINTED DOILIES

FIELD OF THE INVENTION

The invention herein relates to semi-open, multicolor process printed doilies, and more particularly to doilies having a multicolor artwork coating and peripherally positioned patterned cutouts. The invention also relates to a method of making such doilies.

BACKGROUND OF INVENTION

Doilies are a paper product. The vast majority of doilies are made of white paper with patterned cutouts, giving an impression of lace or needlework. They are often used in conjunction with table settings and presentation of food, and are also useful in decorative ways in arts and crafts projects. Being a paper product, doilies are far less expensive than cloth, especially considering the lace or needlework aspect of their appearance. Paper doilies are also relatively inexpensive and disposable, so that there is no need to save them once they are folded, stained from food or used as a temporary decorative item.

Various patterns of paper doilies are available, and they are often embossed to provide the texture of a cloth appearance. Although doilies are generally provided in white paper, they are also sometimes provided in solid colors. For example, red doilies and green doilies are available during the Christmas season, and pink doilies are available for Valentine's Day. Additionally, white doilies have occasionally been printed with simple, spaced-apart graphic symbols, generally denoting a holiday; however, the graphic symbols do not substantially alter the appearance of the doily as a white paper product.

SUMMARY OF INVENTION

Accordingly, it is a principal object of the invention to provide an improved doily.

It is an additional object of the invention to provide doilies with enhanced appearance.

It is a further object of the invention to incorporate printed artwork into a doily.

It is a still further object of the invention to incorporate printed artwork in coordination with patterned cutouts cooperating to enhance the appearance of the doily and artwork.

It is also an object of the invention herein to provide a method of making doilies.

It is another object of the invention to provide a method of making doilies incorporating printed artwork and produced in easily separated layered groups.

The foregoing objects and advantages of the present invention are accomplished in a new and improved doily including a substrate having a top surface, a bottom surface, a periphery and a peripheral margin of the top surface extending inwardly from the periphery to a substantially imperforate central area. A multicolor artwork coating is deposited, substantially covering the top surface by at least four color process printing. The peripheral margin defines patterned cutouts diminishing the substrate and the multicolor artwork coating thereon, thereby relatively emphasizing the multicolor artwork coating in the substantially imperforate central area.

According to additional aspects of the invention, the substrate is generally circular. The material of the substrate is paper, and more specifically precoated paper and paper in a weight range of 30–60 pounds. Alternatively, the substrate is foil. Additionally, the substrate is embossed.

According to other aspects of the invention, the multicolor artwork coating includes color shading portions created by the four or more color process printing. Also, the multicolor artwork coating is printed with inks including an anti-block agent.

According to other aspects of the invention, the patterned cutouts are deployed in an annular repeating pattern, and the pattern extends less than substantially one-half of the radius of a generally circular substrate. Further, the periphery of the substrate is also patterned with periodic incursions.

According to still further aspects of the invention, the multicolor artwork coating depicts flora, including asymmetric overlapping elements and color shading.

The invention herein also includes a method of making doilies having as a step printing a multicolor artwork coating on each of a plurality of rolls of sheet substrate material using an at least four color process printing with ink containing an anti-block agent. Further steps include positioning a plurality of layers of the plurality of rolls of printed sheet substrate material in alignment, cutting the aligned layers sheet substrate material along a periphery and cutting patterned cutouts to form a plurality of layered doilies, and stripping excess sheet substrate material from the doilies.

According to additional aspects of the invention, the layers of printed sheet substrate are also embossed and the cutting of the aligned layers of sheet substrate material provides a patterned periphery and patterned cutouts in the margin of the produced doilies.

According to other aspects of the invention, the multicolor artwork coating is printed on the substrate in a repeating design, whereby the step of cutting does not require registration with the design or any portion thereof.

The invention, together with further objects, features, advantages and aspects thereof, will be more clearly understood from the following description of the preferred embodiments taken in connection with the accompanying drawings.

BRIEF DESCRIPTION OF THE DRAWINGS

The same reference numerals refer to the same elements throughout the various figures.

DESCRIPTION OF PREFERRED EMBODIMENTS

Figure 1:
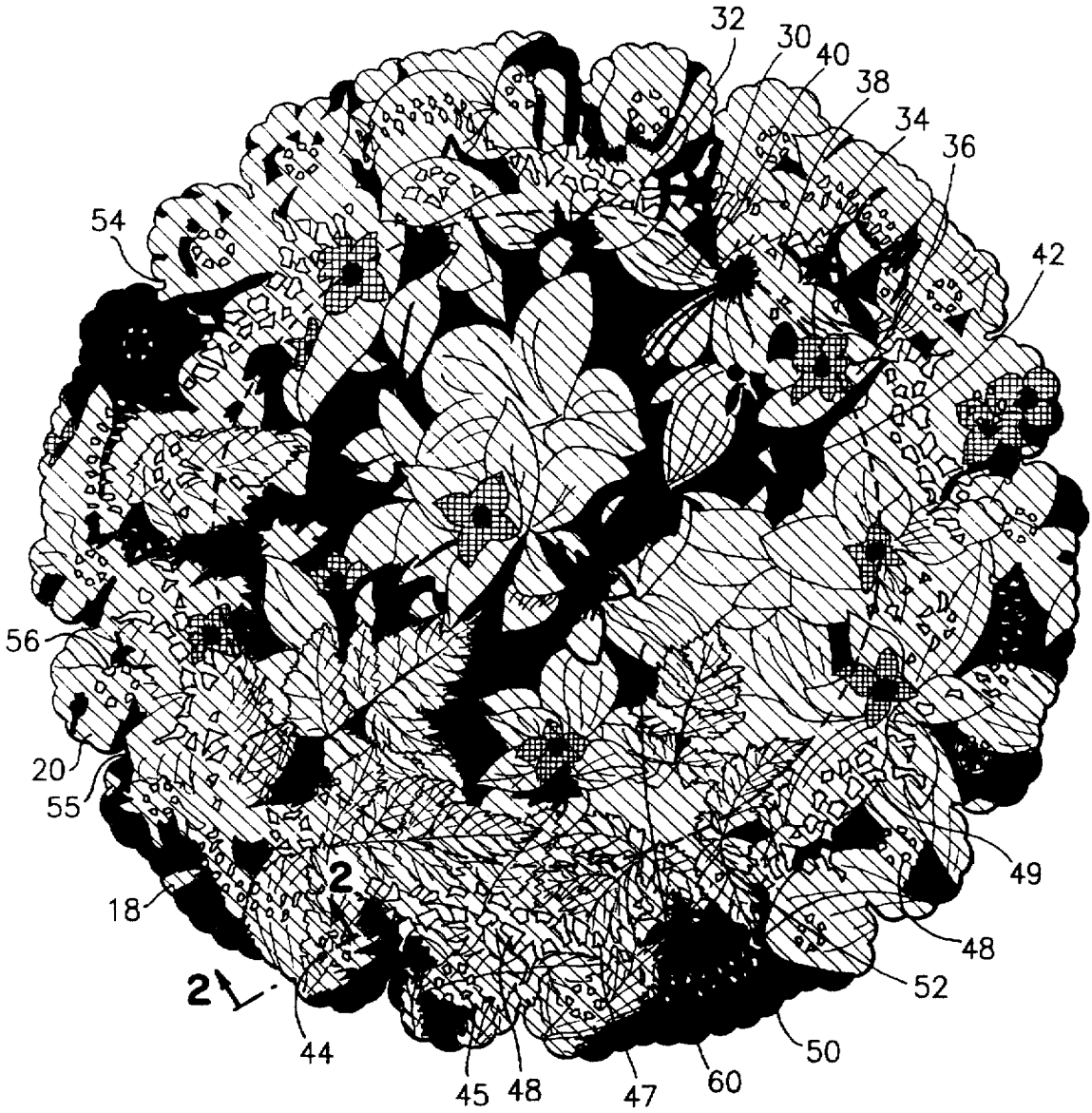
FIG. 1 is a top plan view of a doily according to the invention herein.
Figure 2:
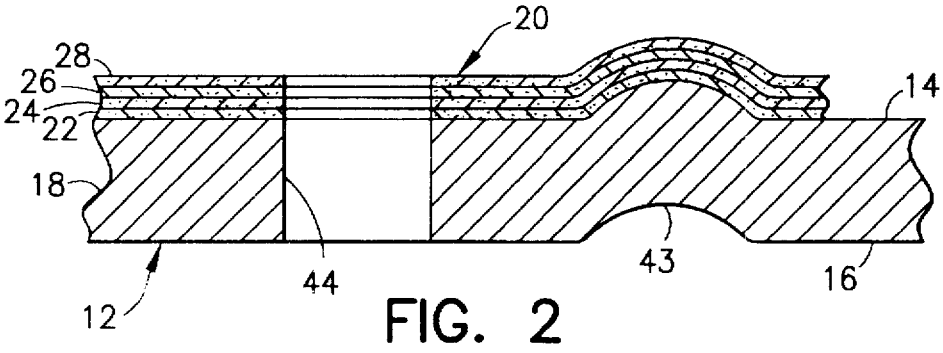
FIG. 2 is a cross-sectional view of a portion of the doily of FIG. 1, partially cut away, taken along the lines 2—2 of FIG. 1.

With reference to FIGS. 1 and 2, a doily 10 according to the invention herein has a substrate 12 which is generally circular when viewed from the top as shown in FIG. 1, the substrate having a top surface 14, a bottom surface 16, and a periphery 18. The substrate 12 is paper and, in the embodiment shown, is 45 pound paper precoated on two sides. The 45 pound specification is the weight of 500 sheets of 25 inch by 38 inch paper, and papers in the range of approximately 30–60 pounds are also suitable as a substrate. The precoating is applied to both sides of the paper in the embodiment shown and is an aqueous clay coating containing a whitening agent, such as titanium oxide, and a binder, such as casein or latex. Precoated papers are known and the coating is generally considered a part of the paper, wherein no separate number is applied to the precoating in the drawing. Other suitable substrates for making a doily according to the invention herein include foil/paper lamination.

The top surface 14 of the substrate 12 has printed thereon a multicolor artwork coating 20. The multicolor artwork coating is placed on the top surface by four color process printing, wherein four layers of ink are sequentially deposited on the top surface 14. With reference to FIG. 2, the four colors of ink are depicted by the layers 22, 24, 26 and 28. In Pantone® process color printing, the colors utilized are process black C, process cyan C, process magenta C and process yellow C. The combinations of these colors layers create different tones and colors in the multicolor artwork 12. The colored inks are also provided with an anti-block agent, as is known in the printing art to make the artwork coating resistant to sticking to adjacent substrates when stacked, and is particularly useful in the doilies according to the invention herein when they are made from aligned layers of substrate material, including the steps of cutting and embossing, as is further discussed below.

The multicolor artwork coating 20 covers substantially the entire top surface 14 of the substrate 12. In the embodiment shown, the artwork of the coating is flora, including leaves and blossoms and other asymmetric design elements, wherein the leaves, blossoms and other elements overlap. Thus, a three-dimensional scene is provided in a two-dimensional presentation as the multicolor artwork coating. More particularly, a leaf 30 overlaps another leaf 32, and blossom 34 overlaps the leaf 30. The leaves, blossoms and other design elements are color shaded, as an artistic rendering of a realistic scene. By way of example, on leaf 36 color is shaded from a light green portion 38 to a darker green portion 40 and includes black shadow areas 42.

When printed by four color process printing, such flora scenes have an appearance of depth and richness. The depth and richness is enhanced when the substrate is a foil/paper lamination, due to the light reflective properties of foil. In addition, the doily 10 may be embossed to provide it with texture, and a ridge 43 formed by embossing is seen in FIG. 2.

The substrate of the doily 10 defines patterned cutouts, with individual cutouts identified by reference numerals 44–49. The patterned cutouts are arrayed along the peripheral margin 50 of the doily 10, which extends from the periphery 18 to the vicinity of dotted line 52. The pattern of cutouts is provided in a repeating pattern, and are complemented by the periphery 18, which is patterned with periodic incursions, such as incursions 54 and 55, coordinating with the cutouts generally indicated at 56.

In the embodiment shown, the peripheral margin of the top surface, defined at its approximate inner extent at dotted line 52 has a width of approximately one-third of the radius of the substrate 12. In general, the doilies according to the invention herein are best presented with the peripheral margin having a width of no more than one-half of the radius of the doily, and preferably in the range of between one-fourth and one-half of the radius of the doily. Thus, the doily 10 has a substantially imperforate center portion 60 where the multicolor artwork coating 20 is not diminished by the patterned cutouts. When viewing the doily 10, and particularly when viewing the doily 10 placed on a contrasting color background, the patterned cutouts along the peripheral margin frame the imperforate center 60 by lightening or diminishing the artwork coating in the peripheral margin, and thereby emphasize the portion of the multicolor artwork coating in the substantially imperforate central area. By substantially imperforate, it is meant that there are no large cutouts, although there may be pinhole openings and minor cutouts, which do not detract from the multicolor artwork coating in the central area. Combined with the depth provided by the four color process printing, the doily achieves a rich, almost three-dimensional appearance.

Figure 3:
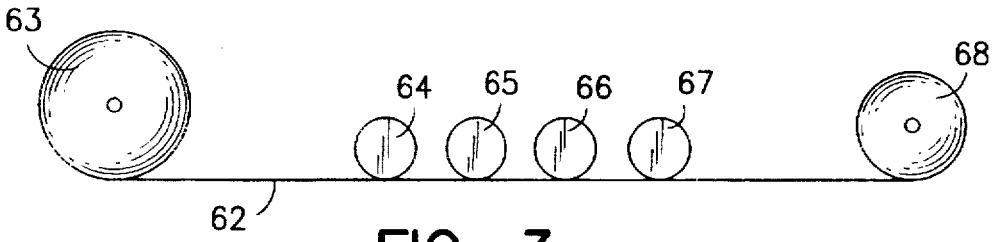
FIG. 3 is a schematic diagram of apparatus and method of printing a multicolor artwork coating on substrate.
Figure 4:
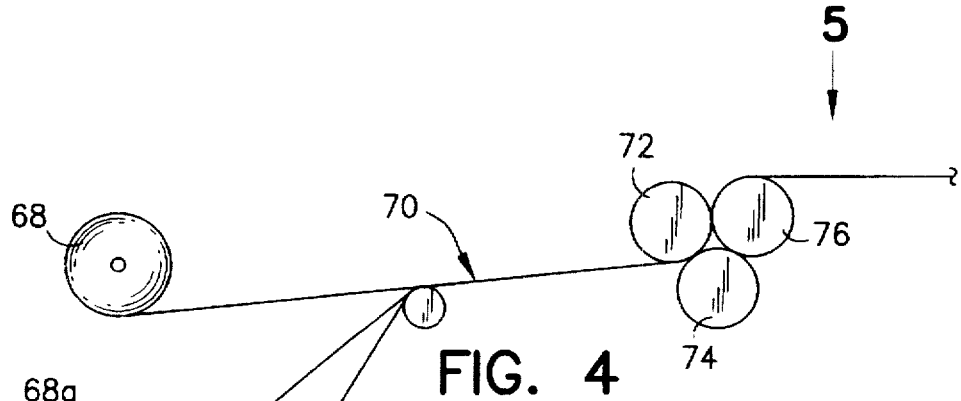
FIG. 4 is a schematic diagram of apparatus and method of positioning layers of aligned printed substrate material and cutting and embossing doilies therefrom.
Figure 5:
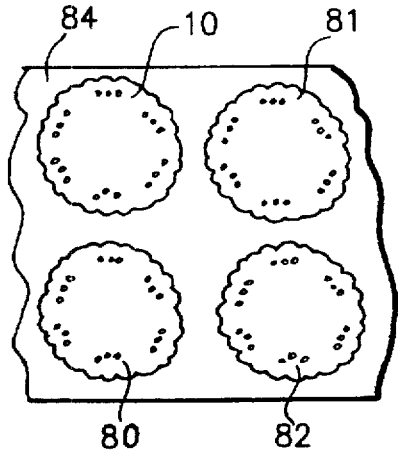
FIG. 5 is a top plan view of aligned layers of sheet material having doilies cut therefrom, and illustrating stripping of excess sheet material.

With reference to FIGS. 3–5, a method of manufacturing doilies according to the invention herein is illustrated. With respect to FIG. 3, sheet substrate material 62 from roll 63 is directed under four color process printing rollers 64–67, to apply the multicolor artwork coating 20 on the substrate. The particular substrate material was discussed above, and is preferably paper coated on two sides, or a foil. The printing rollers are preferably a part of a flexographic printing process, utilizing plates which apply the artwork coating 20 in a repetitive, continuous design without any unprinted portions therebetween. In this regard, the edges of the plates mate and provide a complementary portion of the design. The four print rollers 64–67 apply the four colored inks of the four color process printing, and additional rollers may be provided in the event additional process colors are desired. The ink is provided with an anti-block agent and the printed substrate is rolled into a printed take-up roll of substrate sheet material 68.

With reference to FIG. 4, three rolls 68, **68*a* and 68*b* of printed substrate sheet material provide one layer each of printed substrate, and the sheets are positioned in aligned layers at 70. The aligned layers of printed sheet substrate material are then sequentially passed between a die 72 and a backing roller 74, and then between the same die 72 and backing roller 76. The die 72 contains cutters for cutting out the patterned cutouts, including cutouts 44–49, and is textured for embossing the sheet substrate. The backing roller 74 is adapted to cooperate with the cutters and the backing roller 76 is adapted to cooperate with the textured embossing surface of die 72**.

Thus, down stream of the die 72 and backing rollers 74 and 76, the layers of sheet substrate material include doily 10, stacked with aligned doilies from the underlying layers of sheet substrate material, as well as doilies 80, 81 and 82, which are also stacked with aligned doilies of the underlying layers of sheet substrate material. The excess sheet substrate material 84, seen in FIG. 5, is stripped away from the layered doilies.

The doilies are then placed in stacks of the desired number and packaged. The anti-block agent in the ink prevents the printed artwork coating from sticking to the bottom surface of the sheet substrate material as it is rolled in the take-up roll 68. Further, it serves the same function when the sheet substrate material are layered at 70 in the diagram of FIG. 4, and as the sheets are subjected to the pressures of the die and backing rollers in the process described above and illustrated in FIG. 4. Thus, the finished packaged doilies are easily separable into individual doilies, even though manufactured and packaged in layered groups.

Accordingly, described above are preferred embodiments which admirably achieve the objects of the invention herein.

It will be appreciated that changes may be made from the preferred embodiments without departing from the spirit and scope of the invention, which is limited only by the following claims.

I claim:

1. A doily comprising:

A) substrate having a top surface, a bottom surface, a periphery and a peripheral margin of the top surface extending inwardly from the periphery to a substantially imperforate central area;

B) a multicolor artwork coating deposited on the top surface by at least a four color process printing and substantially covering the top surface of the substrate; and C) the peripheral margin defining patterned cutouts diminishing the substrate and the multicolor artwork coating within the peripheral margin and thereby relatively emphasizing the multicolor artwork coating in the substantially imperforate central area.

2. A doily as defined in claim 1 wherein the substrate is generally circular.

3. A doily as defined in claim 2 wherein the peripheral margin has a width of no more than one-half of the radius of the doily.

4. A doily as defined in claim 3 wherein the peripheral margin has an annular width of between one-fourth to one-half of the radius of the doily.

5. A doily as defined in claim 1 wherein the substrate is paper.

6. A doily as defined in claim 5 wherein the paper is precoated on one side.

7. A doily as defined in claim 6 wherein the paper is precoated on two sides with an aqueous clay precoating containing a whitening agent and a binder.

8. A doily as defined in claim 7 wherein the paper is in the weight range of 30–60 pounds.

9. A doily as defined in claim 1 wherein the substrate is foil/paper lamination.

10. A doily as defined in claim 1 wherein the substrate is embossed.

11. A doily as defined in claim 1 wherein the multicolor artwork coating includes color shaded portions.

12. A doily as defined in claim 1 wherein the multicolor artwork coating is applied with ink including an anti-block agent.

13. A doily as defined in claim 1 wherein the patterned cutouts are provided in an annular repeating pattern about the peripheral margin.

14. A doily as defined in claim 13 wherein the periphery includes periodic inward incursions complementary to the patterned cutouts.

15. A doily as defined in claim 1 wherein the multicolor artwork coating depicts flora having asymmetric overlapping elements, color shading, and outlining.

16. A doily comprising:

A) a generally circular substrate of precoated paper, the substrate having a top surface, a bottom surface, a periphery and a peripheral margin of the top surface extending inwardly by one-fourth to one-half of the radius of the generally circular substrate to a substantially imperforate central area;

B) a multicolor flora artwork coating deposited on the top surface of the substrate by at least a four color process printing substantially covering the top surface, the artwork coating including overlapping design elements and color shaded elements; and C) the peripheral margin defining patterned cutouts in a repeating pattern and the periphery defining incursions partially embracing and complementary to areas of patterned cutouts, the patterned cutouts diminishing the substrate and artwork coating within the peripheral margin and thereby emphasizing the multicolor artwork coating in the substantially imperforate central area.

* * * * *